United States Patent [19]

Hogan

[11] 3,960,160

[45] June 1, 1976

[54] HAIR TREATMENT APPLIANCE

[75] Inventor: Gary LaDon Hogan, North Augusta, S.C.

[73] Assignee: LaDon Corporation, North Augusta, S.C.

[22] Filed: Aug. 15, 1974

[21] Appl. No.: 497,680

[52] U.S. Cl. ..... 132/112; 132/9; 132/11 R

[51] Int. Cl.[2] ..... A45D 24/22

[58] Field of Search ..... 132/9, 11, 112, 120, 132/125, 137–138, 141–142, 159, 160; D86/8

[56] References Cited

UNITED STATES PATENTS

| | | | |
|---|---|---|---|
| 1,525,955 | 2/1925 | Sanders | 132/160 |
| 3,060,941 | 10/1962 | Harloff | 132/11 |
| 3,125,776 | 3/1964 | Lilley | 132/159 |
| 3,133,546 | 5/1964 | Dent | 132/120 |
| 3,384,096 | 5/1968 | Paccione | 132/11 |
| 3,702,616 | 11/1972 | Mercer | 132/9 |
| 3,714,950 | 2/1973 | Miska et al. | 132/112 |
| D211,224 | 5/1968 | Asner | D86/8 |

*Primary Examiner*—G. E. McNeill
*Attorney, Agent, or Firm*—Wellington M. Manning, Jr.

[57] ABSTRACT

A hair treatment appliance is disclosed that is capable of multi-faceted operation in the care and treatment of human hair. A body is provided having generally a hollow compartment therein to receive an aerosol container. A slot in a wall of the compartment permits a dispensing valve of the aerosol container residing thereat to dispense contents of the container therethrough. A comb is secured to an end of the body and extends outwardly therefrom, while at the opposite end, hair lifters, which are a plurality of spaced apart elongated members, are optionally provided. A cap is generally provided adjacent one end of the hollow body and acts as a closure for the hollow compartment that receives the aerosol container. The aerosol container is actuated by a pivotal lever secured to the body on the opposite side of the slot. One or more of the appliances may further be utilized with a central conditioner aerosol supply instead of a single aerosol container.

6 Claims, 7 Drawing Figures

HAIR TREATMENT APPLIANCE

BACKGROUND OF THE INVENTION

Numerous devices have heretofore been developed for care, treatment and manipulation of the human hair. For the most part, such devices have been utilized by stylists and female consumers, though in recent years, the male hair stylists have likewise utilized such devices. Among the referred to devices, various comb arrangements have evolved per se as well as in combination with other implements such as hair lifters and the like. Likewise, other implements such as brushes, rollers, dryers, hot combs and the like have been improved.

Coincident with the development of the type implements discussed above, numerous products come available in aerosol form for spray application onto the human hair. The conventional aerosol container contains an active ingredient and propellant, both of which are mixed in the container and dispensed therefrom in atomized form through a manually operated spray dispensing valve. The active ingredients referred to include hair lacquers to secure the hair in place, dye, tents, and numerous other compositions for the care and treatment of the human hair. Normally, the aerosol containers are 6 to 10 inches in height and are nonreuseable, whereby the can is discarded when empty. Recently, small or minature cans have been employed for limited use when traveling, and the like. Likewise, these minature cans are generally nonreuseable, though a few have been provided with refillable capabilities.

Simplicity often dictates the use for separate implements for combs, brushes and the like. From the standpoint of efficiency and compactness, however, certain appliances have been combined heretofore so that, from a commercial standpoint, a beautician, hair stylist or the like may utilize same in the proper performance of their services to manipulate and/or treat the customer's hair. Certain of these implements have been patented as may be seen in the prior art which is exemplified by U.S. Pat. No. 2,279,708 to Jakob et al.; U.S. Pat. No. 2,617,431 to Gaspari; U.S. Pat. No. 3,059,652 to Thomas; U.S. Pat. No. 3,324,865 to Battaglia; U.S. Pat. No. 3,516,424 to Eagle; and U.S. Pat. No. 3,636,963 to Olson. None of the above listed prior art anticipates or suggests the subject invention. The subject invention provides an improvement thereover, in that, a minature aerosol container is provided for dispensing hair conditioner, hair spray or the like from an appliance that simultaneously provides a comb and/or lifters that may be used to manipulate the hair before, during or after spraying. In this regard, the hair treatment appliance of the present invention is compact and therefore readily transportable in a woman's purse or is compact in the sense of lessening the number of implements required by a hair stylist such that improved results are obtained by the use thereof.

SUMMARY OF THE INVENTION

It is an object of the present invention to provide an improved hair treatment appliance.

Another object of the present invention is to provide a combination appliance for the treatment of hair wherein a hair conditioning material container is housed in a body that also provides a comb and, optionally, hair lifters.

Still further, another object of the present invention is to provide an improved, compact hair treatment appliance.

Generally speaking, the hair treatment appliance of the present invention comprises an elongated body having a hollow compartment therealong, said body having a slot adjacent one end thereof; a comb secured to said body and extending outwardly therefrom; an aerosol container received in said hollow compartment, said aerosol container having a dispensing valve associated therewith, said valve being aligned with said slot in said body to permit dispensing of the contents of the aerosol container and means to selectively actuate the dispensing valve.

More specifically, the hair treatment appliance of the present invention preferably embodies three features, namely, a comb, a refillable aerosol container and a hair lifter device. All three of these elements in combination may be afforded on a single, compact appliance to permit hair to be properly cared for and/or manipulated by a stylist or a consumer.

From the standoint of the comb feature, embodiments are presented wherein the teeth of the comb are alternately long and short to assist in proper handling of the hair and also of particular geometrical configuration. Moreover, while generally speaking, the comb extends axially outwardly from the appliance along a center line through the body, it is also an advantage and thus a further embodiment of the present invention to offset the comb to the outer edge of the appliance body.

The aerosol container is preferably received in a hollow compartment that extends axially along the body of the appliance. Preferably, the container is refillable and is guided into the hollow chamber of the body to facilitate alignment between the dispensing nozzle and the slotted opening. Spring means received in the closure cap are preferably provided to apply pressure against the lower end of the aerosol container and thus insure that the dispensing nozzle is held in the proper position. Once in position, a lever engages the upper side of the dispensing nozzle. The lever is pivotally secured to the body and when depressed, actuates the nozzle and dispenses the contents of the spray container. Once the aerosol container is spent, the closure cap can be removed and the container withdrawn for refilling or replacement. In a further preferred embodiment, a hair lifter which is a plurality of spaced apart elongated metal elements is secured to the closure and extend outwardly therefrom so as to provide the triple-faceted hair treating appliance.

It is conceivable in certain situations that a single supply unit may be employed containing the hair treating material with conduit leading from the single supply to a plurality of hair treating stations with one of the appliances of the present invention located at each station and receiving the supply conduit. Each hollow chamber would not receive a separate aerosol container, but the individual appliance would receive conduit from the supply therewithin where the conduit terminates at a dispensing valve. In similar fashion, a hand manipulated trigger could be employed in conjunction with the dispensing valve to control dispensing of the hair treating fluid therefrom at the individual unit.

DESCRIPTION OF THE PREFERRED EMBODIMENTS

Figure 1:
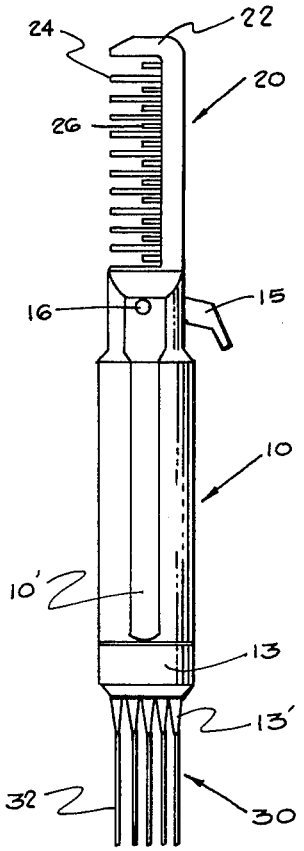
FIG. 1 is a side elevational view of a hair treating appliance according to the present invention.
Figure 2:
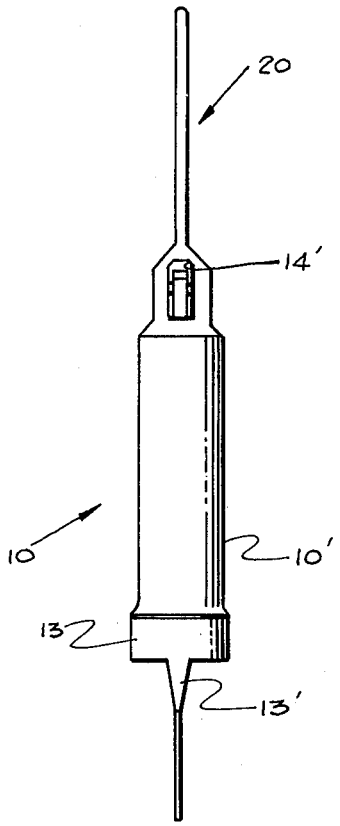
FIG. 2 is a rear view of the appliance as shown in FIG. 1.
Figure 3:
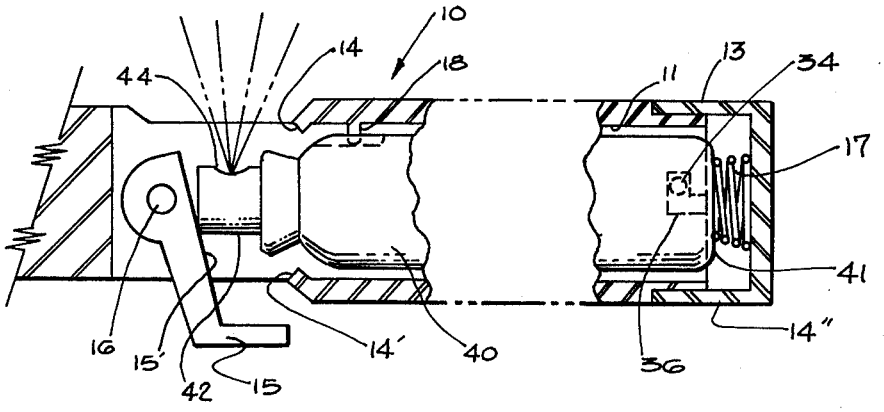
FIG. 3 is a partial cross sectional view of an embodiment of the hair treating appliance according to the teachings of the present invention.

Referring to the drawings, preferred embodiments of the present invention will now be described in detail. In FIGS. 1 through 3, the hair treating appliance of the present invention is shown having a body generally indicated as 10 with a comb section 20 secured thereto and extending upwardly therefrom in an axial direction generally along the center line of body 10. A hair lifter element generally indicated as 30 is shown at an opposite end of body 10. Body 10 is elongated and has a hollow chamber 11 therealong, one end of chamber 11 having a closure cap 13 secured thereto in suitable fashion. Body 10 further has a dispensing slot opening 14 therein, the purpose of which will be described hereinafter, and an opposite opening 14'. A lever 15 is suitably received in opening 14' adjacent hollow chamber 11 of body 10 and is pivotally secured to body 10 by a pin 16. The purpose of lever 15 will be described hereinafter. If desired, and as illustrated in FIG. 1, the exterior of body 10 may be provided with suitable flats 10' or the like to suitably conform the body 10 to user's hand, and thus afford a better and more comfortable fit.

Comb 20 as shown in FIG. 1 extends outwardly from body 10 along a central axis therethrough and comprises a backbone 22 having a plurality of teeth 24 and 26 extending outwardly therefrom in a direction transverse to the elongated direction of body 10. As can be seen in FIG. 1, long teeth 24 and short teeth 26 alternate along the length of backbone 22 to afford an improved tooth arrangement for the comb.

At an opposite end of body 10 secured to closure 13 are a plurality of lifter members 32 that define hair lifter element 30. Lifter members 32 are preferably elongated metal rods that are secured to surrounding plastic ferrule-like sections 13' that protrude from end closure 13. Hair lifter members may also be produced from a plastic material, though metal is preferred due to the fact that the metal elements better penetrate the hair.

Closure 13 may be secured to body 10 in any suitable fashion. For example, FIG. 3 illustrates a pin-slot arrangement. A pin 34 is secured to a portion of body 10 that receives cap 13. A mating slot 36 is provided on the inner periphery of a skirt 13'' of closure 13. In suitable fashion, slot 36 extends spirally around the inner periphery of skirt 14'' of closure 14 so as to permit a locking effect upon turning closure 14 thereround with pin 34 passing therealong.

A minature aerosol container 40 is shown received in chamber 11 of body 10 in FIG. 3. Closure cap 13 received over the lower end thereof holds container 40 within compartment U and spring means 17 received within cap 13 applies spring tension against container 40. Aerosol container 40 has a dispensing valve 42 secured at one end thereof with a nozzle 44 thereon in alignment with slot 14 of body 10. A spring means such as the coil spring 17 secured within closure 13 applies spring tension against a lower end of aerosol container 40 whereby dispensing valve is held in contact with a lever 15. Lever 15 serves as a trigger for the appliance and upon depression thereof, an underside 15' forces dispensing valve 42 downwardly and provides an aerosol spray of the contents from container 40 to exit through nozzle 44 and slot 14 of body 10. Preferably, aerosol container 40 is refillable by removal of the dispensing valve 42 after which additional material may be placed within container 40 suitable for aerosol dispensing. The refillable characteristics of the container 40, however, does not from a structural feature of the present invention, per se. Hence, particular details of structure of the container so as to facilitate refilling are not believed to be necessary, since such details are well within the purview of those skilled in the art. Alignment means may further be provided, such as one or more pins 18 that are provided within chamber 11 and extend inwardly against an outer grooved surface of container 40 as shown in phantom. Container 40 may then be aligned to insure that dispensing valve 42 and nozzle 44 are adjacent slot 14 for dispensing therethrough. Misalignment and/or the necessity of manual alignment would thus be avoided.

Figure 4:
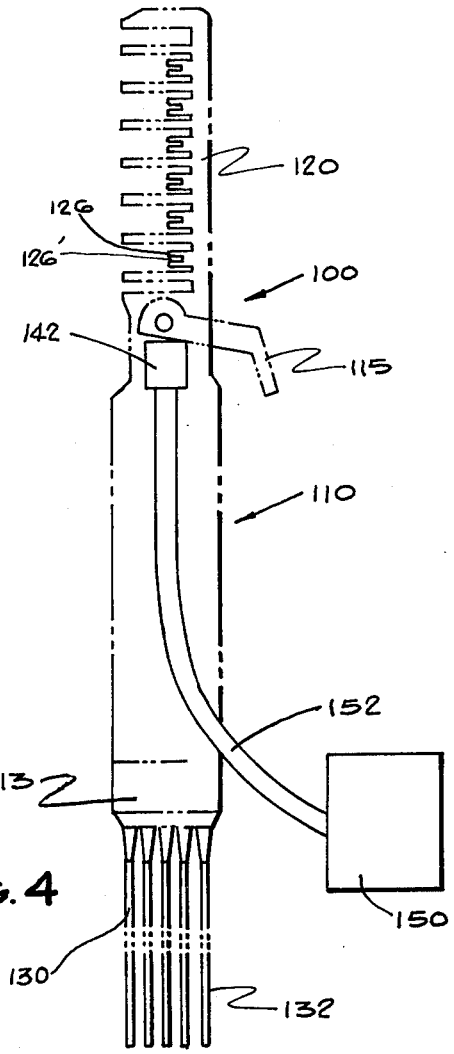
FIG. 4 is a side elevational view of a further embodiment of the appliance of the present invention.

Referring to FIG. 4, a further embodiment of the present invention is illustrated for possible commercial use. A remote central matieral supply 150 is illustrated having a conduit 152 connecting same with a dispensing valve 42 of an appliance generally indicated as 100. Each hair styling booth would thus have conduit 152 leading from supply 150 to its personal appliance 100. The small aerosol units 40 that are preferred for personal use would thus not be utilized and greater economy and convenience would be realized. In this arrangement, the comb 120 is likewise provided along with the hair lifter element 130, if desired. Further, in this regard, the closure cap 113 would only be utilized if necessary to incorporate the lifter elements 132 thereon. In any event, conduit 152 would convey the desired treating material to the dispensing valve 142 where the dispensing valve would be actuated by manipulation of lever 115 that is pivotally secured to body 110. Short teeth 126 of comb 120 are also shown with slots 126 therein, whereby an improved comb arrangement results.

Figure 5:
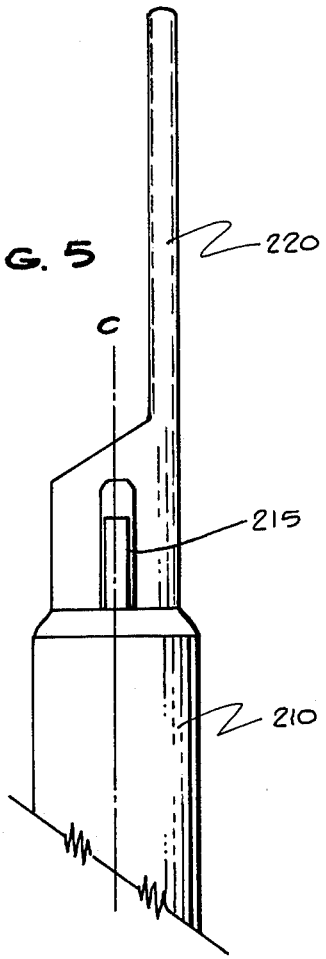
FIG. 5 is a partial rear view of a portion of a hair treating appliance of the present invention showing a further embodiment thereof.

A still further embodiment of the present invention is illustrated in FIG. 5. The combs 20 and 120 that have been illustrated with the other Figures is shown in FIG. 5 as comb 220 that is offset from a central axis C extending through body 210 of the present invention. In this regard, as shown in FIG. 5, comb 220 is offset to the right of center line C and permits improved manipulation of the appliance by the hair stylist or a person using same. Otherwise, the unit could employ any of the various embodiments discussed hereinbefore.

Figure 6:
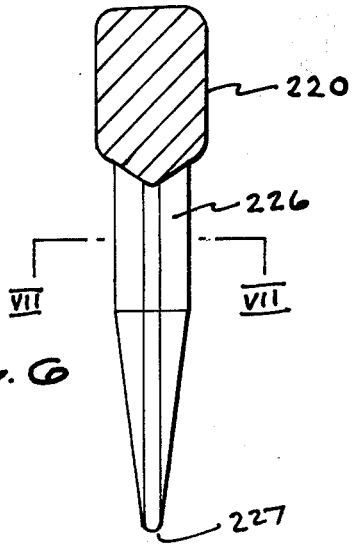
FIG. 6 is a vertical cross section of a further embodiment of a tooth for the comb of the present invention.
Figure 7:
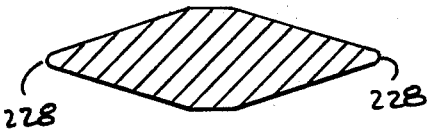
FIG. 7 is a horizontal cross section of the tooth as shown in FIG. 6 along a line VII—VII.

A further embodiment of a comb tooth is illustrated in FIGS. 6 and 7. Tooth 226 is shown integral with comb 220 and tapering to a lower end 227. End 227 of tooth 226 is diamond shaped in cross section as shown in FIG. 7 for better action on the hair. To prevent cutting the hair, however, each edge 228 of the diamond cross section along with the extremeties of end 227 are radiused. A smooth geometric tooth is thus provided and is suitable for both long and short teeth.

Insofar as construction is concerned, the body and comb of the present invention are preferably an integral plastic product. Injection molding techniques may be conveniently employed, after which a trigger is pivotally secured thereto. The closures are also separately molded so as to be removeable from the body and thus permit access to the hollow separately manufactured chamber, whereby the aerosol containers are conveniently receivable therein. Moreover, a preferred technique, as mentioned above, utilizes metal lifter elements which are molded into the end of the closure and extend outwardly therefrom with tapering plastic ferrule-like portions around the base thereof, thereby adding rigidity and strength to the unit. It should be understood, however, that if preferred, materials of construction may be different from that set forth hereinabove.

Having described the present invention in detail, it is obvious that one skilled in the art will be able to make variations and modifications thereto without departing from the scope of the invention. Accordingly, the scope of the present invention should be determined only by the claims appended hereto.

What is claimed is:

1. A hair treatment appliance comprising:

a. an elongated body, said body having a hollow compartment longitudinally thereof, said body having a pair of oppositely positioned slots adjacent an end thereof;

b. a trigger lever pivotally secured within said compartment and extending outwardly through one of said slots in said body, and changing direction outside said body to provide an area for engagement of said trigger;

c. a closure cap secureable at an end of said body opposite said slots, said closure cap having a plurality of elongated hair lifter elements secured thereto and extending outwardly therefrom in a generally parallel arrangement; and d. an aerosol container receivable in said compartment, said container having a dispensing valve engageable with said trigger lever, said valve being directed through a slot opposite the slot through which said trigger lever extends to expel an aerosol spray through said opposite slot when said trigger lever is depressed.

2. A hair treatment appliance comprising:

a. an elongated hollow body, said body having two slots adjacent one end thereof and a removeable cap at an opposite end thereof, said cap having a plurality of spaced apart elongated members secured thereto and extending outwardly therefrom;

b. a comb integral with said body adjacent said slots and extending axially outwardly therefrom;

c. a removeable aerosol container received in said hollow body and held therein by said cap, said container having a dispensing valve in alignment with one of said slots to permit dispensing of the contents of the container therethrough; and d. trigger means pivotally secured to said body and extending through the other of said slots, said trigger means being engageable with said dispensing valve to dispense said contents when actuated.

3. A hair treatment appliance as defined in claim 2 wherein said integral comb and body and said cap are plastic and the elongated members secured to said cap are metal.

4. A hair treatment appliance as defined in claim 2 wherein said comb is provided with a plurality of long and short teeth.

5. A hair treatment appliance as defined in claim 2 wherein the comb teeth have a diamond cross section and are radiused at outer edges and the lower end thereof.

6. A hair treatment appliance as defined in claim 2 wherein the trigger means is a lever that is pivotally secured within said body, and extends outwardly through said opposite slot, an underside of said lever engaging said dispensing valve to actuate same when said lever is depressed.

* * * * *